US005452882A

United States Patent [19]

Wunning

[11] Patent Number: 5,452,882

[45] Date of Patent: Sep. 26, 1995

[54] APPARATUS FOR QUENCHING METALLIC RING-SHAPED WORKPIECES

[76] Inventor: Joachim Wunning, Berghalde 20, D-7250 Leonberg, Germany

[21] Appl. No.: 336,796

[22] Filed: Nov. 9, 1994

Related U.S. Application Data

[63] Continuation of Ser. No. 29,113, Mar. 10, 1993, abandoned.

[30] Foreign Application Priority Data

Mar. 17, 1992 [DE] Germany ..... 42 08 485.7

[51] Int. Cl.[6] ..... C21D 1/613; C21D 1/673

[52] U.S. Cl. ..... 266/251; 266/258; 266/259; 266/80; 266/96; 266/117; 266/118

[58] Field of Search ..... 266/117, 118, 266/251, 258, 259, 114, 80, 96

[56] References Cited

U.S. PATENT DOCUMENTS

| | | | |
|---|---|---|---|
| 1,533,639 | 4/1925 | Ehn | 266/117 |
| 3,294,599 | 12/1966 | Huseby | 266/113 |
| 3,782,705 | 1/1974 | Westeren et al. | 266/250 |
| 4,171,126 | 10/1979 | Zahn et al. | 266/250 |
| 4,596,610 | 6/1986 | Kuhn | 266/252 |
| 4,634,103 | 1/1987 | Schmetz et al. | 266/250 |
| 4,867,808 | 9/1989 | Heilmann et al. | 148/634 |
| 4,906,182 | 3/1990 | Moller | 266/250 |

FOREIGN PATENT DOCUMENTS

| | | |
|---|---|---|
| 0129701A1 | 1/1985 | European Pat. Off. . |
| 0120233A3 | 7/1985 | European Pat. Off. . |
| 0313888A1 | 5/1989 | European Pat. Off. . |
| 2601658 | 7/1977 | Germany . |
| WO89/12111 | 12/1989 | WIPO . |

OTHER PUBLICATIONS

"Der Konvektive Wärmeübergang unter Dësenfeldern—. . . ", Oftentechnik, H. Klammer et al, Feb. 24, 1986, pp. 155–160.

"Untersuchungen Zum Konvektiven . . . ", Udo Spiecker, Sep. 27, 1990 pp. 38–39 and Bild 23.

*Primary Examiner*—David A. Simmons
*Assistant Examiner*—Sikyin Ip
*Attorney, Agent, or Firm*—Frishauf, Holtz, Goodman, Langer & Chick

[57] ABSTRACT

For quenching heated metallic work pieces with a quenching intensity that liés in the region of H values from 0.2 to 4, which is typical for oil or water quenching, a cooling gas is used as the quenching medium in the form of discrete jet streams issuing from a nozzle field and impinging on the work piece surface to be cooled. With limiting of the blower power for the cooling gas serving a predetermined maximum limit of about 1000 kW per square meter of nozzle field the quenching intensity, with suitable selection of gas jet parameters, in particular the gas velocity w, the gas pressure p, the gas jet cross-section and the number of impinging jets per unit of surface is brought to an H value between 0.2 and 4.

22 Claims, 6 Drawing Sheets

APPARATUS FOR QUENCHING METALLIC RING-SHAPED WORKPIECES

This application is a continuation of application Ser. 08/029,113, filed Mar. 30, 1993, now abandoned.

This invention concerns a method of quenching metallic workpieces with a quenching medium at a quenching intensity that lies in a difficult region for oil or water quenching (H=0.2 to 4). The invention also concerns an apparatus for carrying out the method just mentioned, particularly for treating workpieces that are rotation-symmetric, such as rings, gears, disks, shafts and the like. Such an apparatus has a quenching chamber in which at least one space is provided for treating individual workpieces which is at least partly surrounded by an array of nozzles.

BACKGROUND AND PRIOR ART

Quenching systems for hardening workpieces of steel and other metals are of great importance in technology, because the properties of the workpieces important for their use can be considerably improved by quenching. Quenching in water or oil, as well as in salt baths or in fluidized beds, have long been known. Recently, the chilling of workpieces in a gas stream has also been used, in which case a heat treated charge in a chilling chamber is subjected to a stream of cooling gas guided in a circulating path over a heat exchanger. The applied stream of gas is provided in the form of discrete jets for affecting the workpiece surfaces that are to be chilled.

An industrial furnace be equipped with such a quenching apparatus is described in European Patent 0151 700 A2 and U.S. Pat. No. 4,653,732.

The hardness and/or toughness enhancements which are attainable by quenching the workpieces, i.e. by their rapid chilling from heat treatment temperature to room temperature, precisely depend on whether the quenching process takes place at high speed after a suitable previous temperature time course has taken place for the material of the workpiece in question. For this purpose it is necessary, during the chilling process to lead away the heat present in the workpiece at a correspondingly high heat flow density through the cooled surface. The magnitude of the attainable heat flow density in each case depends upon, among other things, the heat transfer coefficient $\alpha$ which is measured in terms of $W/n^2K$. For describing the quenching effect or intensity it is common in practice, in the hardening of steel, to utilize a characteristic value, the so called H value attributed to Grossmann (M. A. Grossmann, N. Asimov, S. F. Urban, "The Hardenability of Alloy Steel" ASM Cleveland, 1939, Pages 124 to 190). This H value, on the basis of experience, lies in a region from about 0.2 to 4 for the known quenching systems using salt baths or oil, and in a region from about H=0.9 to 4, for water quenching. Known gas quenching exists only for H values in the range from 0.1 to 0.2 (compare, for example, "Handbuch der Fertigungstechnik" Carl Hansen Verlag, Munich and Vienna, Vol. 4/2, 1987, Page 1014). Higher values up to approximately 0.2 can be obtained only with strong circulation and/or overpressure.

The utilization of the known quenching systems with liquid quenching media in the H value range of 0.2 to 4 brings with it a series of fundamental difficulties which are fully known in practice. Since y the use of a liquid as a quenching medium the intensity of quenching can be varied only slightly during the chilling in practice, which variation would frequently be desirable in order to avoid hardness cracks and changes in dimensions of the workpiece, the result is that not seldom some problems of quality arise, which lead to cost problems, because the lack of controllability of the quenching process can be compensated for only by providing costly alloy elements (in steels which are to be hardened). The remnants of quenching oil, salt or water additives adhering to the workpiece after quenching must be cleaned off the workpiece and then be discarded, thus leading to an environmental problem. Finally, the most common quenching medium, namely oil, involves a danger of fire, with the consequence that safety problems also arise which require special precautions.

The above mentioned environmental and safety problems do not arise in the known gas quenching, as they are described, for example, in the above mentioned U.S. Pat. No. 4,653,732, but nevertheless it is possible to use such known gas quenching systems, because of low quenching intensity (H<0.2), only for hardening highly alloyed steels, even if the process is performed under higher than atmospheric pressure.

SUMMARY OF THE INVENTION

It is an object of this invention to provide a quenching method as well as a quenching apparatus suitable for carrying out the method which will make it possible to provide a quenching intensity in the H value region from about 0.2 to 4 without having to deal with the above described problems.

A cooling gas is used as the quenching medium, which is brought to bear through discrete high-impact jets issuing from an array or field of nozzles, impinging effectively on the workpiece surfaces which are to be chilled. When there is an upper limit of the feed capacity for the cooling gas at a predetermined maximum value of about 100 kW per square meter of nozzle array, yet by suitable choice of gas jet parameters, especially the gas velocity w, the gas pressure p, the gas jet cross section area and the number of impinging jets per surface unit, the quenching intensity can be brought to an H value between 0.2 and 4.

The invention is based on the surprising recognition that it is possible, in the use of a nozzle field or array having a suitable selected nozzle centers spacing t, with relatively small effective nozzle diameter d and small spacing h between the nozzle array and the workpiece that is to be chilled and optionally with increased gas pressure p in the impingement field, to use a chilling gas to obtain a high transfer of heat from the workpiece surface to the cooling gas stream without any need to increase the necessary blowing power for the supply of cooling gas to the nozzle field to an extent that would make the entire process uneconomical.

It is of course known from U.S. Pat. No. 4,653,732 that by the use of a nozzle field or array for chilling a workpiece it is possible to obtain a good convective heat transfer from the workpiece that is to be chilled to a gaseous medium, but it has heretofore continued to appear to be evidently impossible to obtain in this way, in a reasonably economic manner, high values of the chilling intensity that are typical for hardening metals by oil and water quenching. That was because, if the chilling gas velocity is raised, the energy requirement for the gas supply increases with the third power of the gas velocity and thus an increase of the gas velocity was essentially out of the question for the nozzle arrays of heretofore known gaseous chilling systems.

The new process makes it possible to operate at the known high H values for salt bed, oil or water quenching of metallic workpieces, without having to accept the disadvantages of known non-gaseous quenching media. As a result there is also the advantage that, especially in the critical quenching phase of workpieces of unalloyed or low-alloy steel, the quenching intensity can be reproducibly regulated within a few seconds.

Such regulation can be performed in a simple way by control acting on the cooling gas supplying blower, the output of which impinges on the nozzle field and/or on the cooling gas pressure in the system.

Experience and practice has shown that, in the case of e new process, a cooling gas velocity w of w=40 to 200 m/sec. is attainable with an effective nozzle diameter d=0.5 to 10 mm in the nozzle field nd with a nozzle spacing t in the array of t=4d to 8d and a chilling gas pressure p in the system of p=0.5 to 20 bar. For these conditions the nozzle field is separated from the surface to be chilled by a spacing h of h=2d to 8d.

Air, nitrogen or a gas mixture can be used as the chilling gas. Especially in cases in which the previous heat treatment is carried out in a protective gas atmosphere, it is useful to select the same protective gas as the cooling gas in the quenching operation.

In order to increase the chilling effect, if necessary the chilling gas may be hydrogen or another gas having higher heat conductivity than air, in a proportion between 0 and 100% by volume. This hydrogen can also be added as such to the cooling gas. Such an addition reduces at the same time the drive power of the blower supplying the cooling gas.

Especially in application of the process where the workpieces are heated in a protective gas atmosphere or in a furnace chamber, it is desirable for the workpieces to be heated in one chamber and then immediately quenched with an essentially identical gas atmosphere being used for both heating and quenching, in which case the gas pressure can be maintained in the chamber at least for a while. This becomes more important in working with a cooling gas (for example protective gas) to which hydrogen is added for increasing the cooling effect. Such a hydrogen contribution signifies a certain risk of explosion, which can be counteracted, however, by keeping the gas chamber as small as possible, a condition, that is systematically favorable in the new process, because the nozzle field is disposed at a small spacing from the workpiece surface to be chilled, so that only small volumes of gap spaces are filled with the cooling gas. With heating of the workpieces in a protective gas atmosphere of a furnace chamber the gaseous quenching can therefore take place immediately at the exit of the furnace chamber, i.e. in a space that is part of the furnace chamber at least for a while.

The new method of the present invention can be installed as such for quenching objects with any particular shape; if it is used for quenching hollow workpieces, especially ring shape or tubular workpieces, it is then useful to project the impinging jets of cooling gas from a nozzle field disposed to correspond to the shape of the workpiece and to apply those jets for effect both on the outer and on the inner surface, as well as on an end surface if there is one. Finally it can be of advantage if during the quenching a relative movement is maintained at least for a while between the workpiece surface and the impinging jets of the nozzle field. In such a movement, for example, a ring shaped or disc shaped workpiece or the nozzle field opposite it can be rotated while the opposing nozzle field or workpiece is stationary.

The quenching apparatus or device for carrying out the new method has a quenching chamber in which at least one space is provided, at least partly bounded by a nozzle field, for accepting individual workpieces. This space, according to the invention, is implemented as an essentially closed space. The nozzle field is constituted in a form fitted to the shape of the surface to be chilled above the workpiece brought into the quenching space and is so disposed and dimensioned that in operation that surface of the workpiece is impacted essentially by discrete impinging jets of the cooling gas with generation of a quenching intensity that lies in the range (H=0.2 to 4) which is typical for oil or water quenching. The jet-propelling power from the blower means impinging on the nozzle field is to be limited to a maximum of about 1,000 kW per square meter of the nozzle field.

At least a few nozzles of the nozzle field can be equipped with selectively activatable throttle valves and/or closure valves in order to influence, if necessary, the quenching effect at particular locations of the surface of the workpiece, especially for locally reducing the effect. The nozzle field can also, at least in part, be a unit interchangeably installable in the quenching chamber, so that the quenching apparatus can be adapted to each workpiece shape in a simple way. In other words, it is as a rule necessary to provide a special nozzle field for each workpiece shape.

Driving means can be installed in the quenching chamber for rotating the workpieces placed therein, particularly for rotation-symmetric workpieces and/or for rotating at least a part of the nozzle field. Such driving equipment can be implemented by a mechanical system driven from the outside or else by a turbine element that can be driven by the cooling gas or by both of those means. The turbo drive by the cooling gas has the advantage that no supplementary drive source is needed. In this way evenly distributed cooling for a circumference can be reduced, especially for light workpiece that are rotation-symmetric, such as rings, gears, discs, shafts and the like. The space in the quenching chamber surrounded by the nozzle field can also be constituted as a pressure chamber, so that during the quenching process the pressure can be raised in the quenching system, whereby the cooling effect can be further intensified.

One of the great advantages of the new quenching method and the quenching apparatus operating in accordance therewith is that the quenching intensity can be controlled in a predetermined reproducible fashion in its time course, and thereby the temperature/time course of the cooling of the workpiece can be made to correspond to the requirements of the particular workpiece and its material. For that purpose the quenching apparatus can have its own process computer or microprocessor for controlling the time course of the chilling procedure, to which process data such as flow quantity, pressure, temperature, composition of the cooling gas, etc. and workpiece-specific data, such as geometrical shape, dimensions, material composition, etc. and/or characteristic data for the nozzle field can be supplied as inputs and the output signals computed therefrom in accordance with the program can be used for influencing the cooling gas impingement of the nozzle field and/or the effective cooling gas throughput cross-section of at least a few nozzles of the nozzle field and/or a relative movement between the workpiece and the nozzle field. The cooling effect at the workpiece surface to be chilled can be varied by program control means through corresponding influencing of velocity and/or pressure of the impinging jets and/or the effective temperature cross-section of nozzles of the nozzle field on the basis of simulating the quenching effect of an oil or water hardening procedure. In this way there can be duplicated or imitated, by throttling the cooling effect according to a pre-determined temperature/time curve, or by corresponding reduction of the cooling gas velocity and/or the cooling gas pressure, etc., the effect of an oil hardening for hardening in a heated bath in salt.

Especially in regard to the reduction of the danger of explosion in the use of a hydrogen addition to the cooling gas, as well as with regard to the reduction of the blower power for the supply of cooling gas, it is frequently of advantage for the quenching apparatus to be located immediately at the exit of a furnace chamber of a continuously operating pass-through furnace which contains a protective gas atmosphere, especially the exit of a continuous roller-hearth furnace, with the connection between the furnace and the quenching apparatus being essentially gas tight. The quenching apparatus can for that purpose have a loading and unloading chamber standing connected with the furnace and closed off from the exterior by a selectively activatable door. The loading and unloading chamber can also be connected to the space surrounded by the nozzle field by selectively activatable closing means which permit the quenching process to proceed at least for a while under cooling gas overpressure.

If there are only small numbers of units of the workpieces to be processed, these can as a rule be brought in one behind the other into the quenching chamber, and there quenched and thereafter delivered to their next destination. In order to increase the throughput, however, the quenching apparatus can also have several quenching chambers arranged next to each other and operable in parallel. Finally, an arrangement can be provided by which the quenching apparatus has several quenching chambers one behind the other which are connected together by a transport device which is optionally subject to interposition of other treatment stations, perhaps for tempering the workpieces, etc. In that case the quenching chambers can be equipped for operation with respectively different quenching effect. In that way it is for example possible, with different cooling gas input temperatures, to obtain a stepwise cooling.

BRIEF DESCRIPTION OF THE DRAWINGS

The invention will be further explained by way of illustrative example, with reference to the drawings, in which.

DESCRIPTION OF THE ILLUSTRATED APPARATUS AND PROCESS

Figure 1:
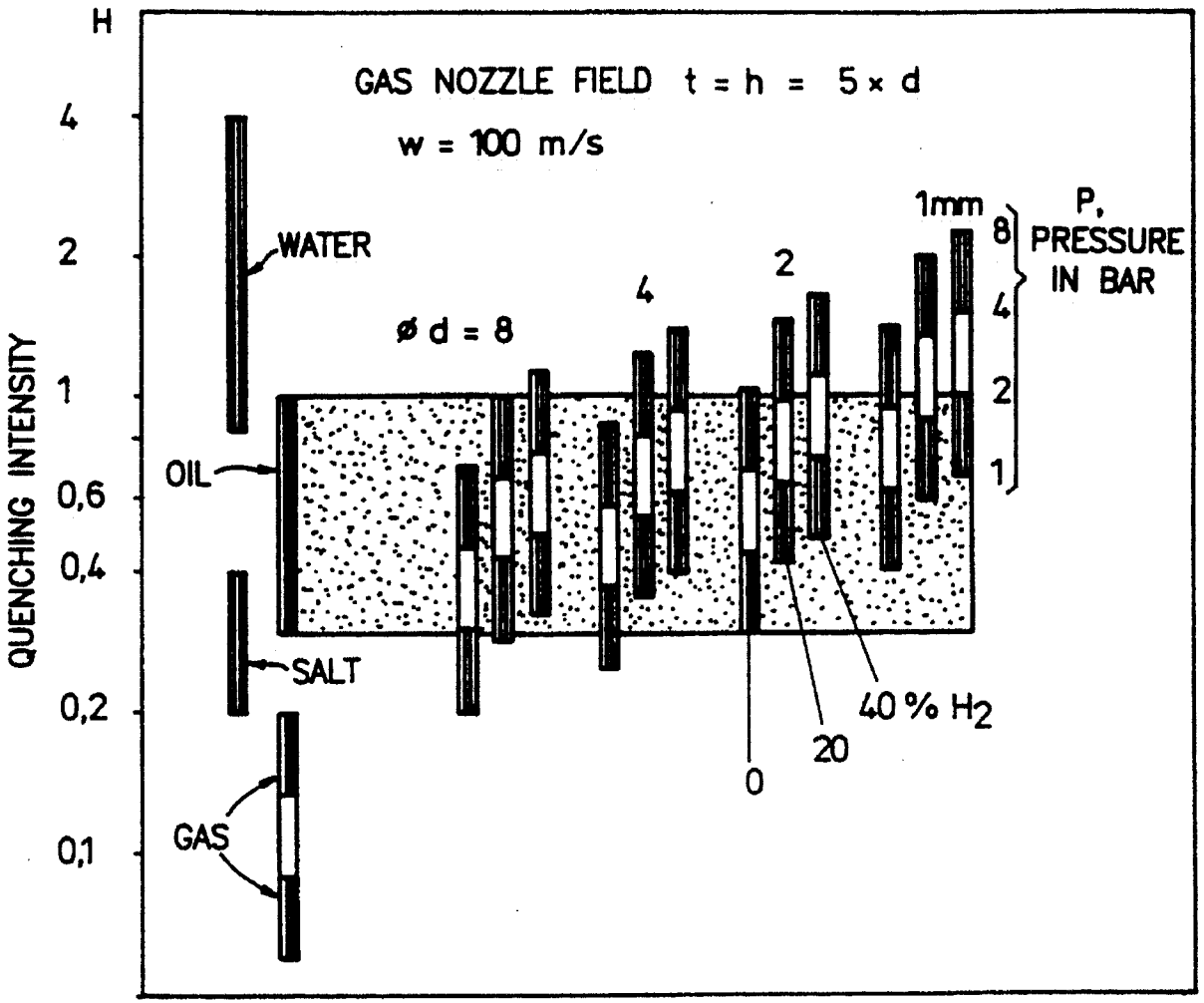
FIG. 1 is a diagram illustrating the quenching intensities obtainable in accordance with the invention for various gas nozzle fields in comparison with conventional quenching systems.

The tabular diagram of FIG. 1 in its left-hand portion shows characteristics of the known quenching systems, which use mainly gas, salts, oil or water as the quenching medium, in terms of the quenching effect on the work piece that is obtainable, the so-called quenching intensity, described by the so-called H value given on the scale at the left of FIG. 1. It is evident from FIG. 1 that in the range of H values from about 0.05 to 4 the greatest quenching intensity, i.e. the most abrupt chilling, heretofore of interest in practice was only attainable by the use of water as the quenching medium. The H value for a water quenching system lies between about 0.8 and 4. With oil as a quenching medium, depending upon whether mild or abrupt quenching is carried out, H values from about 0.3 to 1 are obtainable, while warm bath quenching systems operate in salt quenching with an H value from about 0.2 to 0.4. The attainable quenching intensity with the known gas quenching systems is relatively low; it lies in a range of H values that has a maximum of about H=0.2. Gas quenching of work pieces in a stack through which gas is caused to flow is known to have heretofore produced H values of the order of magnitude of 0.1.

The present invention is based on the recognition that it is unexpectedly possible to carry out gas quenching of work pieces consisting of steel in such a way that a quenching intensity is obtained in the region of H=0.2 to 4 which is typical for oil or water quenching. That result is obtained without raising the gas velocity to practically unrealizable high values or uneconomic circulation of large quantities of gas. In other words, these results are obtained without requiring the feed power for the cooling gas to exceed a predetermined economically acceptable upper limit.

In order to obtain the applicability of cooling gas as quenching medium for high quenching intensity corresponding to the high H values from 0.2 to 4, in the new process the cooling gas is brought to affect the work piece surface to be cooled in the form of discrete impact jets issuing from a nozzle field. A corresponding selection of gas jet parameters, in particular the gas velocity W, the gas pressure P and the number of impinging jets per unit of area the quenching intensity, can be controllably set.

The above-described features will now be further explained with reference to quenching apparatus operating, according to the new quenching method, for quenching roller bearing rings, which is described in FIGS. 2 to 5.

Figure 2:
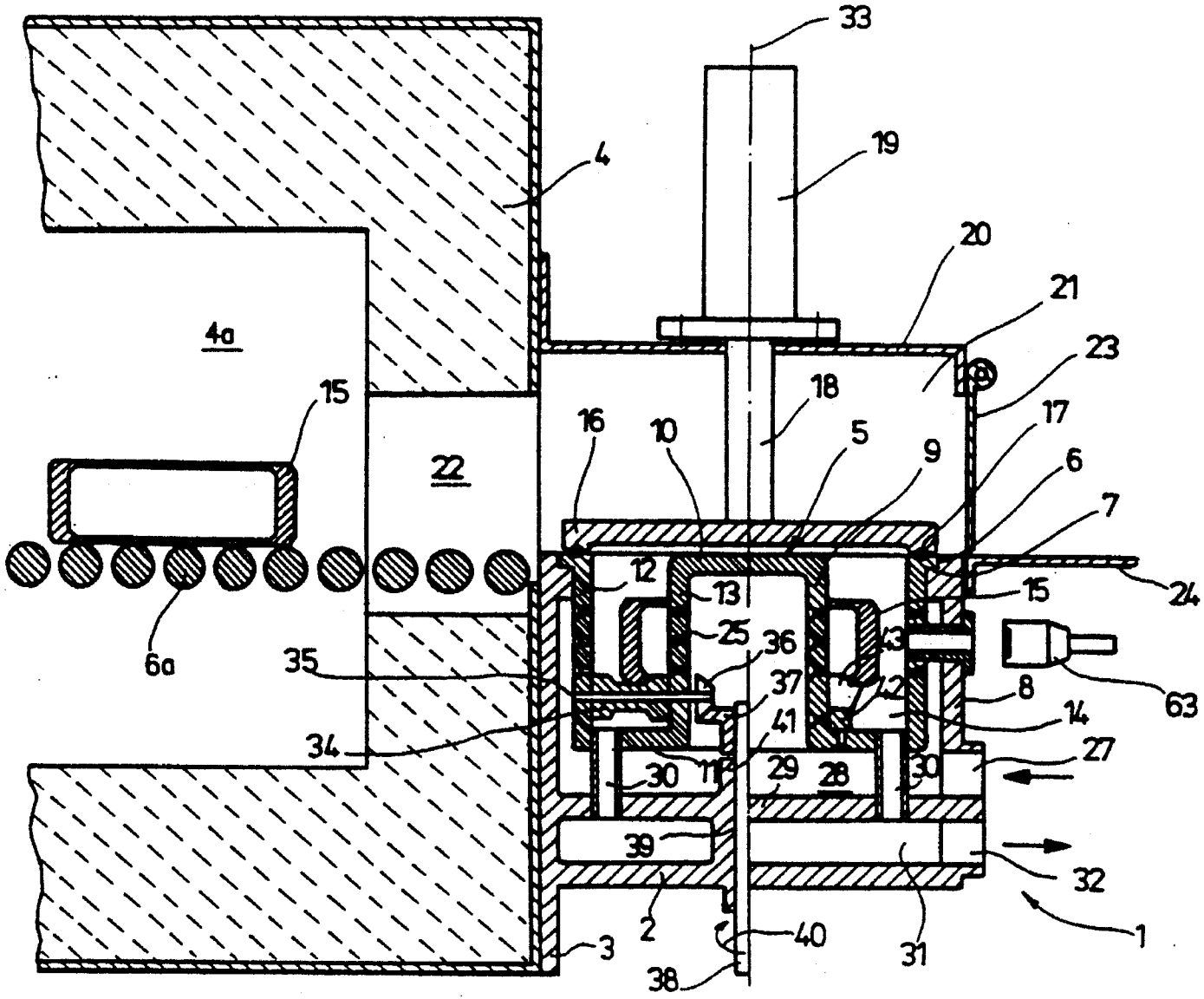
FIG. 2 is an axial section in side view and in schematical representation of a quenching installation according to the invention which is built onto the exit of the furnace chamber of a continuous roller-hearth furnace.

As shown in FIG. 2, the quenching equipment 1 has a casing 2 which carries a flange 3 which goes around the furnace 4 and by which it is applied gas-tightly to the outer wall of the rolling hearth furnace 4. The furnace chamber is shown at *4a* and its rolling hearth at *6a*. The essentially box-shaped casing 2 forms the actual quenching chamber. A pot-shaped cylindrical insert 5 is inserted from above into the casing 2 and is set within the surrounding casing wall 8 which is laterally spaced from the insert 5, that being done with the help of a flange 6 which is sealed on to a corresponding ring shoulder 7.

The insert 5 is constituted with a middle part 9 having a hollow cylindrical shape that is closed at its upper end with an end wall 10 that is integral with the cylindrical walls. At the opposite end of the cylindrical middle portion there is a likewise integral flat portion, in this case extending outwardly as a circular ring flange 11, which leads into an outer cylindrical wall 12 which is coaxial with the internal cylindrical wall 13 of the middle portion 9. The respective bottoms of the outer and inner cylindrical walls together bound the annular flange 11 to form a ring space 14 the size of which, in axial and radial directions, is so dimensioned that exactly one roller bearing ring 15 can be placed therein as the workpiece to be chilled. The ring space 14 is closed off above, during the quenching procedure, by a selectively actuatable cover 16 which is shown in FIG. 2 in its closed position, sealed around its edges by a seal ring 17. The cover 16 is connected with the piston rod 18 of a pneumatic lift cylinder 19 which is affixed on a part of the casing 2 which forms the hood 20, which hood, in common with the insert 5 and the outer side wall 8 of the casing, forms the boundary of the unloading chamber 21. The loading and unloading chamber 21 is located directly connected, i.e. without any intervening sluice, with the furnace chamber 5 through the furnace exit 22. It is closed off at its opposite side by a door 23, which can be selectively opened or closed. Beneath the door a receiving table 24 is attached to the casing wall 8 and is flush with the top of the insert 5.

The inner and outer cylindrical walls 12, 13 of the insert 5 are equipped with radial cylindrical nozzle bores 25 which have mutually parallel axes and are disposed so as to be essentially horizontally directed. Each of the nozzle bores 25 is provided with a funnel-shaped depression 26 on the outer side of the outer cylinder wall 12 and on the inner side of the inner cylinder wall 13.

The nozzle bores 25 are disposed on both sides of the ring space 14 to form a nozzle field that laterally surrounds the ring space 14 over its axial height on its inner and outer sides.

In operation the nozzle bores 25 are force-fed with cooling gas which is supplied over a conduit connection 27 to a pressure chamber 28 provided in the casing 2, which, as can be seen in FIG. 2, is closed off at the top by the insert 5 and is surrounded on one side by the inner and outer cylindrical walls 17, 13 and the annular wall 12. The cooling gas going through the nozzle bores 25 of the nozzle field into the ring space 14 is guided over at least two pipe stubs 30 into a collecting chamber 31 of the casing 2, these pipe stubs passing through the annular wall 11 and the floor 29 of the pressure chamber. The collecting chamber 31 is connected to a pipe connection 32 and is disposed underneath the pressure chamber 28.

Supports for the roller bearing ring 15 that is to be quenched are located in the annular space 14. These supports hold the roller bearing ring 15 with the correct height position and at the correct spacing from the nozzle bores 25 of the nozzle field. These supports in the illustrative embodiment here described are of a shape that permit the mounted roller bearing ring 5 to be put into rotation coaxial with the insert 5 and radially mid-way between the nozzle field portions respectively in the outer and inner cylinder walls 12 and 13 during the quenching procedure. The axis of that rotation is shown at 33 in FIG. 2.

In order to produce the above-described operation differently constituted drive means are used, of which two embodiments are shown in FIG. 2, as now described. On the side lying to the left of the axis 33 there are shown drive and support means which consist of a number of flanged rollers 34 having a length slightly shorter than the radial width of the ring space 14 in which they are located and supported on radial shafts 35, which are supported on corresponding bearings in the inner and outer cylindrical walls of the space 14 and properly sealed. Each shaft 35 carries a bevel gear 36 keyed on the end portion of the shaft which is located in the central cavity 9 of the insert 5. Each bevel gear 36 is in contact with a common ring gear 37 which is seated on a drive shaft 38, coaxially to the axis 33, and is rotatably mounted in a corresponding bearing bore 39 of the casing 2. The shaft 38 is set into rotation in the direction shown in FIG. 2 by the arrow 40 by a drive not further shown in the drawing. This shaft is sealed-off at 41 in the region of its passage into the pressure chamber 28.

An alternative embodiment of a drive is shown in FIG. 2 to the right of the axis 33. Here the drive and support means are provided by a turbine ring 42 which is mounted rotatably in bearings on the ring wall 11 and the inner cylinder wall 13 of the ring space 14. The turbine ring 42 has blades shown at 43 on which the roller bearing ring 15 is supported. In operation its drive is produced by the nozzle bores 25 which are located in the region of the annular wall 22 below the turbine ring 43 and are actuated with cooling gas coming from the pressure chamber 28.

Figure 4:
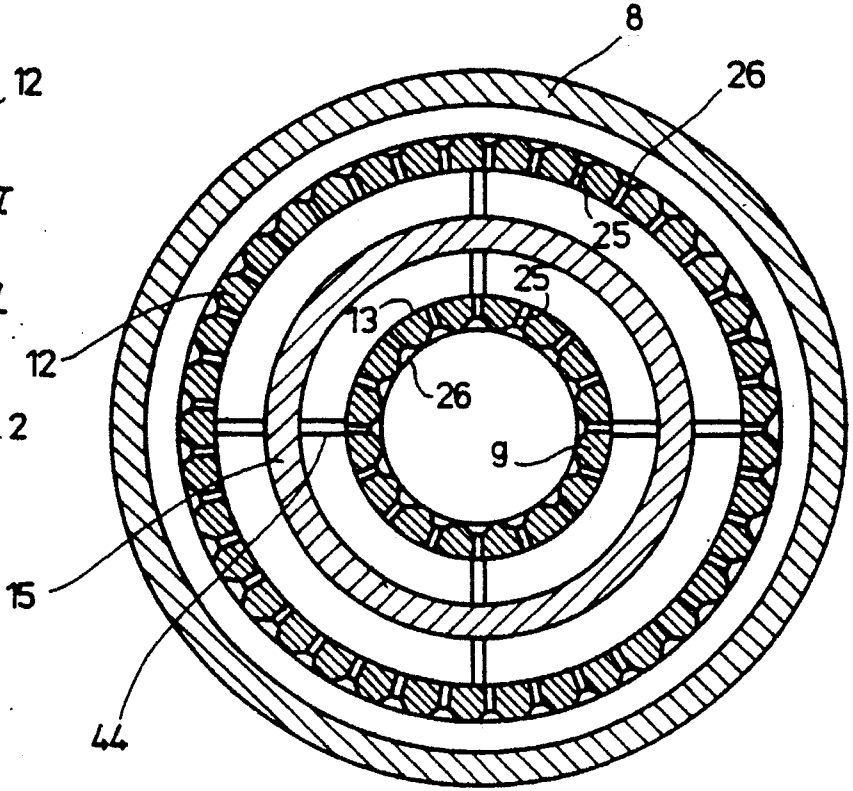
FIG. 4 is a view of a section of FIG. 3 on the line A—A of FIG. 3 from above.
Figure 3:
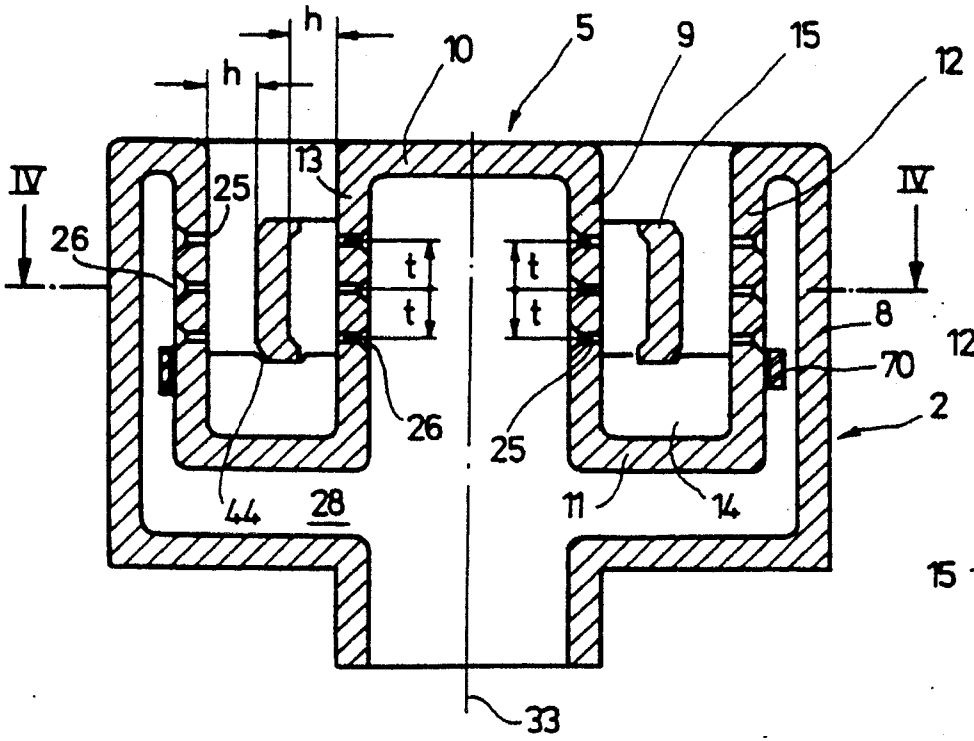
FIG. 3 is an axial section of the nozzle field of a quenching installation according to FIG. 2 in a basic representation and on a different scale.

The construction of the nozzle field formed by the nozzle bores 25 is shown in detail in FIGS. 3 and 4 with reference to a schematic model or pattern of the insert 5 and the casing 2 surrounding it. In this model representation the same parts that appear in FIG. 2 are designated by the same reference numerals.

In the nozzle field cylindrical nozzle bores 25 having the same diameter d are arranged in a uniform distribution spacing t of the nozzles. The nozzle field includes, in this illustrative embodiment, three nozzle bore rows (see FIG. 3) at identical spacing t, i.e. coresponding to the lateral nozzle distribution spacing t. The roller bearing ring 15 which is to be quenched is disposed in the ring chamber 14 on drive and support means, shown by the support edges 44, coaxial with the axis 33, at such a height that in the axial direction it is located symmetrically to the three nozzle bore rows placed one above the other (see FIG. 3). Furthermore, the roller bearing ring 15·is seated radially centered in the ring chamber 14, which signifies that the radial spacings h between the nozzle field and the outer or inner surrounding surfaces of the roller bearing ring are of the same size. Since the nozzle bores 25 of the nozzle field are oriented at right angles to the axis 33, they are also directed at right angles to the inner and outer circumferential surfaces of the roller bearing ring 15. The gas jets issuing from the nozzle bores 25 therefore meet the outer and inner circumferential surfaces of the roller bearing ring 15 in the form of discrete impinging jets.

The nozzle field here-described has the following characteristic dimensions:

nozzle bore diameter: d=0.5 to 10 mm nozzle bore distribution: t=4 d to 8 d spacing of nozzle field from the work piece surface to be chilled: h=2 d to 8 d In operation the pressure chamber 28 is force-fed with cooling gas from a blower 45 (FIG. 5) through a pipe connection fitting 27, so that the overall pressure P in the system, i.e. in the pressure chamber 28, is from 0.5 to 20 bars.

The gas velocity w=40 to 200 m/sec. at the exit of the nozzle bores 25.

Since the insert 5 carrying the nozzle field is removably inserted in the casing 8, the nozzle field, by replacing the insert 5 by a interchangeable inserts can quite simply be adapted to different dimensions and sizes of the roller bearing rings 15 to be quenched for other ring-shaped work pieces. What is important in each case is that the nozzle field accords with the shape of the work piece to be quenched as exactly as possible, in order to obtain the most uniform impingement upon the work piece surfaces to be chilled by the impact jets issuing out of the nozzle bores 25 of the nozzle field. In the treatment of annular or disc-shaped work pieces, gears and he like various different shapes of the insert 5 and its parts supporting the nozzle field can be provided. The nozzle field can, as in the present case, consist of several sections which respectively cool inner and outer or upper and lower surfaces of the work piece. The nozzle bore diameter d and the spacing h between the nozzles and the work piece surface to be cooled are always relatively small.

In the illustrative example here described the quenching equipment 1 is annexed directly to the exit of the roller hearth furnace 4, the basic construction of which is described, for example, in German Patent 38 16 503. When the cover 16 is open the ring space 14 is therefore directly connected with the furnace chamber 4*a*, which contains a protective gas atmosphere. Thus the heating of the roller bearing rings 15 and their following quenching in the nozzle field of the quenching equipment 1 take place in a common protective gas chamber, which permits the saving of protective gas and of time which would otherwise be necessary for closing partitions (sluices). The risk of explosion in case of provision of a hydrogen content to the protective gas is at the same time reduced to a minimum.

Basically the cover 16 (FIG. 2) can also be omitted from the structure if in view of the material of the work piece to be chilled it is possible to establish the exposure with a relatively small cooling gas pressure in the ring space 14. It is also possible to perform the heating and quenching in the nozzle field of the quenching equipment i in a common high pressure chamber formed by the furnace chamber 4*a* and the ring space 14, when the walls of these chambers are sufficiently resistant to high pressure. In that way also the pressure partition provided by the cover 16 can be dispensed with.

Figure 5:
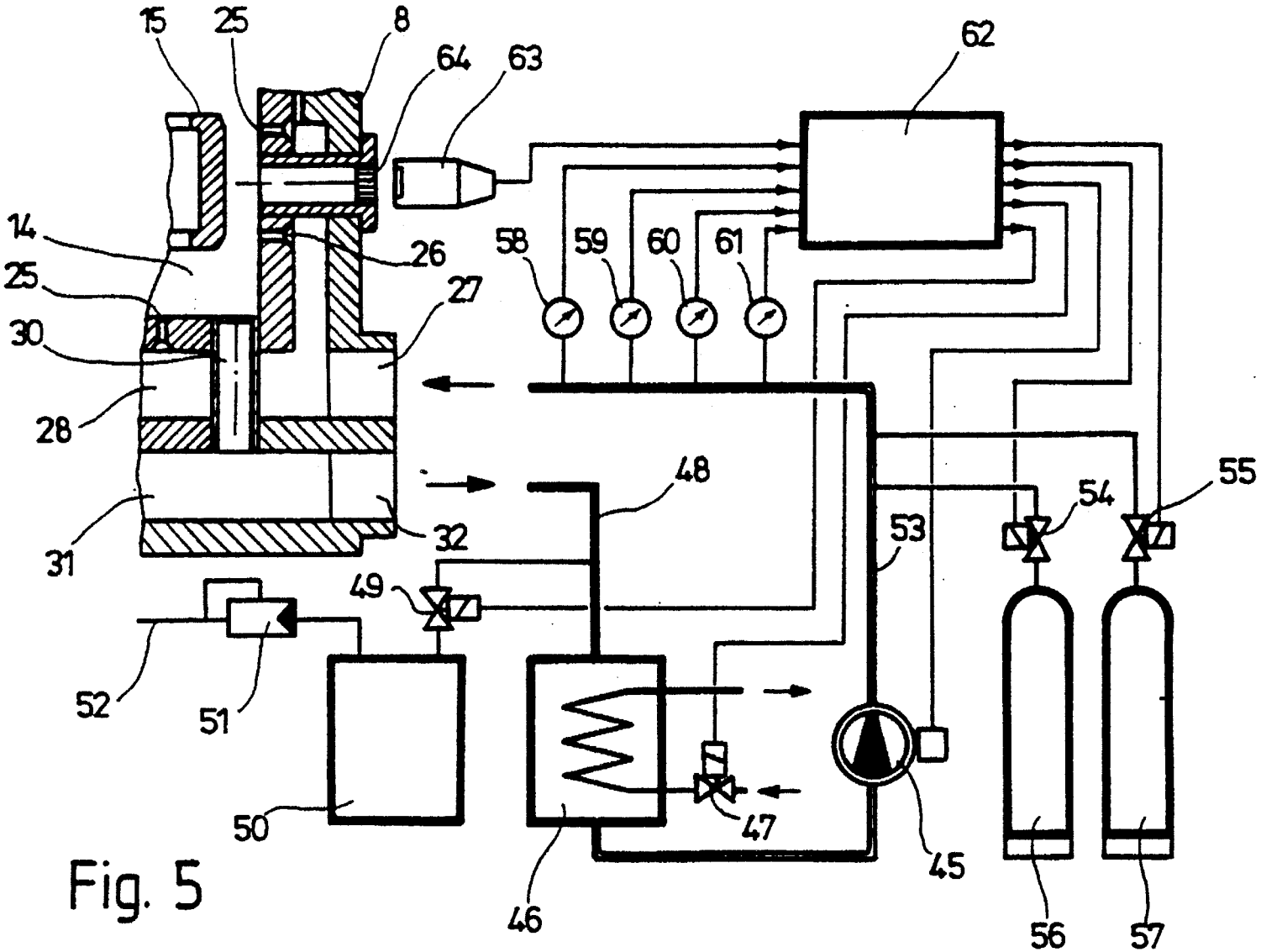
FIG. 5 is a schematic representation of the cooling gas supply device of the quenching installation of FIG. 1, together with the related control system.

The cooling gas supply of the quenching equipment 1 is shown in FIG. 5. The blower 16 which force-feeds the pressure chamber 28 with cooling gas through the pipe fitting 27 is connected on its suction side, through a gas cooler 46 having a coolant setting control 47, with the pipe fitting 32 of the casing 2. The cooling gas pipe piece 48 connected between the gas cooler 46 and the pipe fitting 12 is secured onto a pressure tension release container 50 through an adjustable valve 49. From the pressure tension release container there leads away, through a pressure controller 51, a waste gas pipe 52 which, if desired, can lead back into the furnace chamber 4*a*. On the pressure side of the blower 45 two compressed gas bottles 56 and 57 are connected to the pressure pipe 53 through control valves 54 and 55. The pressurized gas bottles contain additive gas, for example hydrogen and/or nitrogen. In addition, sensors 58, 59, 60 and 61 are provided in the pressure pipe 53 for measuring the quantity of flow, temperature, pressure and composition of the cooling gas fed into the pressure chamber 28.

These sensors have their outputs connected with a process computer 62 to which they supply signals designating the characteristic magnitudes that they respectively monitor. The process computer 62 also receives signals identifying the actual temperature of the roller bearing ring that is to be quenched, these signals being delivered by a temperature sensor 63, which sensors the outer circumference surface of the roller bearing ring through the window 64 inserted in the casing wall 8 and the insert 5 in a pressure-tight way.

From the process-specific signals received from the sensors 58–61 (flow quantity, temperature, pressure and composition of the cooling gas) and from the previously entered data of characteristics of the work piece 15 to be treated (geometry and material values) as well as the characteristics of the nozzle field, the process computer calculates output signals for controlling the blower 45, the additive quantity controlling valves 54, 55, the setting valve 47 for the coolant and the setting valve 49 leading into the pressure tension release container 50. Together with the signals received from the temperature sensor 63 for the actual temperature of the work piece 15 the process computer 62 regulates the quenching procedure automatically for the work piece located in the ring space 14. The process computer can regulate extensively every prescribed temperature-time course for the surface that is to be chilled of the work piece 15.

In the operation of the described installation the work pieces represented by the roller bearing rings 15 on the rolling hearth 6 are continuously advanced through the furnace chamber 5 and are heated in the protective gas atmosphere there contained to a hardening temperature. After the end of this heating the roller bearing rings 15 individually reach, sequentially, the loading and unloading chamber 21 of the quenching equipment 1 after passing through the furnace exit 22 (FIG. 2). The cover 16 is in the open upper position when the door 23 is closed. The incoming roller bearing ring 15 arriving in the loading and unloading chamber 21 falls into the ring chamber 14 in which it comes to rest correctly in position on the drive and/or support means, for example on the flanged rollers 35 or on the turbine ring 42. Thereafter the cover 16 is closed; the blower 45 (FIG. 5) is switched on, and the pressure chamber 28 is force fed with cooling gas which is the same protective gas that is contained in the furnace chamber 5.

The cooling gas issuing out of the nozzle bores 25 meets the outer and inner circumferential surfaces of the roller bearing ring 15 in the form of impinging jets and provides and abrupt and uniform cooling of the rotating roller bearing ring 15. The cooling gas flowing away from the roller bearing ring 15 is sucked off through the pipe fitting 30 by the blower 45 so that the heat quantity that has been picked up by the gas is removed in the gas cooler 46. The temperature-time course of the cooling is controlled by the process computer in the way already described. After the chilling has reached the desired temperature the blower 45 is shut-off, the cover 16 is opened and the chilled roller bearing ring 15 is taken out of the ring chamber 14 by a manipulator (not shown) and is deposited on the shelf 24 and for a short time the door 23 is open. After the closing of the door 23 the quenching equipment is ready for chilling the next roller bearing ring 15 supplied by the rolling hearth.

The quenching intensity which is attainable in the above-described way by gas quenching in the nozzle field appears at the right side of the diagram of FIG. 1 for comparison with the quenching intensities such are attainable by the known quenching systems. Four nozzle fields are shown, of which the nozzle bore diameter d is, respectively, one, two, four and eight mm. The nozzle distribution spacing t and the spacing h between the nozzle field and the work piece are both five times the value of d. The gas velocity w is 100 m/sec.

The power necessary for the gas supply of the blower 15 is, approximately:

$$N=50\times p.(1-0.009.\text{vol }\%.\ H_2)\ kW \text{ per } m^2$$

of nozzle field, but it in no case exceeds a maximum limit value of 1000 kW per square meter of nozzle field.

For each nozzle bore diameter d the gas pressure p is shown for a scale between 1 and 8 bar.

It can be seen from the diagram that the quenching intensity is raised as the nozzle bore diameter becomes smaller. In consequence, in the interest of using the least possible blower power, on the basis of the four nozzle fields compared in FIG. 1 having d=1, 2, 4 and 8, the smallest nozzle field, for example with d =1 mm, is to be preferred. The diagram shows that it is possible to obtain quenching effect or intensity of an average oil quenching (H=0.4 to 0.7) without overpressure and this with a blower power of 35 to 50 kW per square meter of nozzle field.

Nozzle bore diameters less than 1 mm are practical only in special cases because of the danger of dirt accumulation and because of the small spacing. On the other hand, it can be necessary to increase the nozzle bore diameter d and with it at the same time the spacing H of the nozzle field from the work piece surface to be chilled if the work pieces to be quenched are larger or have a specially shaped surface, as for example is in the case with gears. For the same H value this must be compensated by a higher pressure p and a comparably raised blower power.

In general the quenching intensity can be raised by raising the pressure p of the cooling gas and by reducing the nozzle bore diameter d while maintaining the small spacing h. A further raising of the quenching intensity is available by addition of a gas having the higher heat conduction capability than air, especially hydrogen, which is often contained anyway in protective gases used in a furnace. An addition of helium will have a comparable effect which, however, does not as a rule come into consideration for economic reasons. The diagram of FIG. 1 shows that with a nozzle bore diameter of 1 mm and a pressure of 8 bars it is readily possible to obtain quenching intensities such as are typical for water quenching (H=2).

Figure 6:
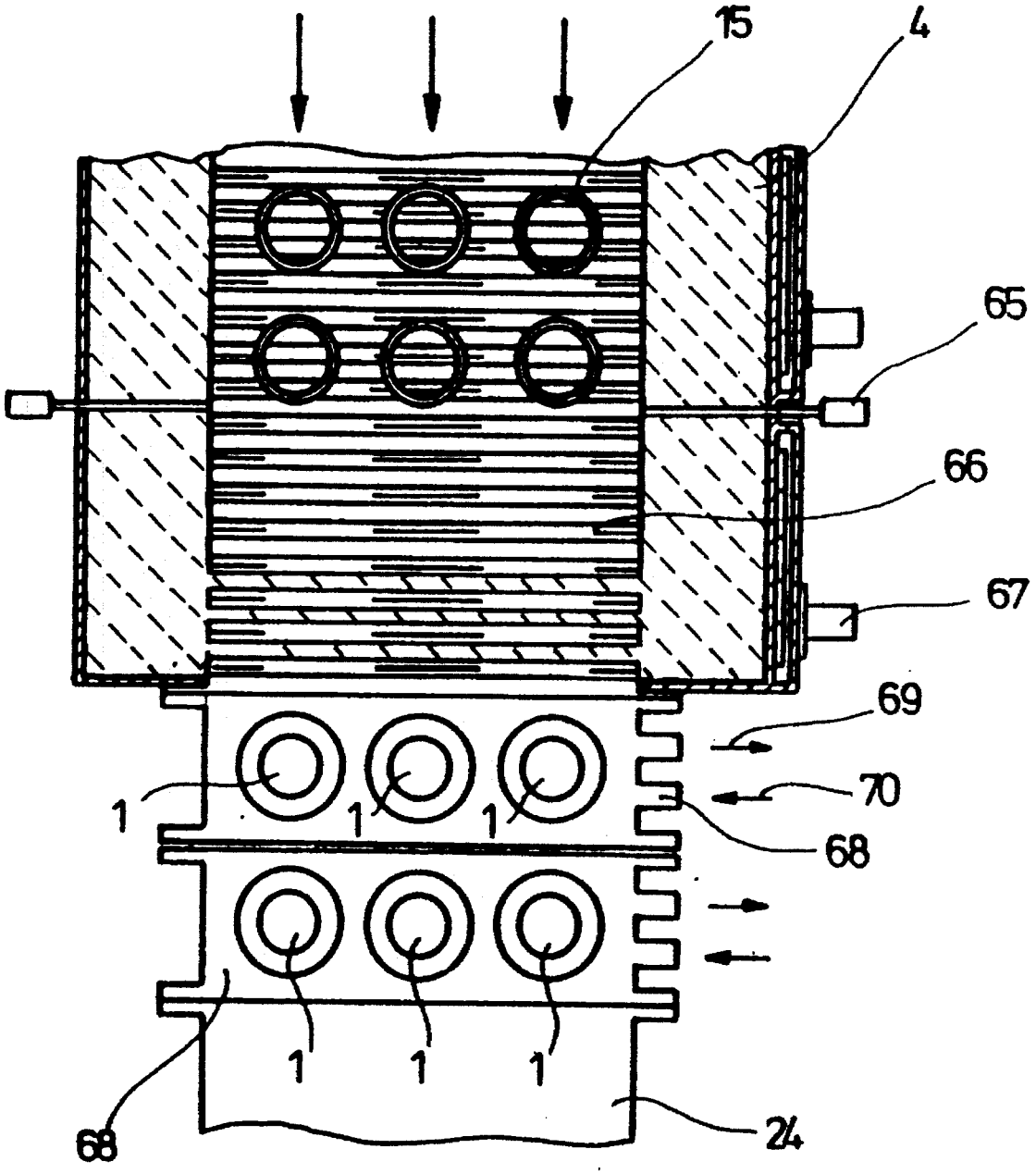
FIG. 6 is a schematic partial representation, in top view, of an installation for hardening rings having two quenching devices lined up one behind the other, in accordance with the invention.

The quenching equipment now to be explained with reference to FIGS. 2–5, constructed next to a continuous gas-through furnace, for example the roller hearth furnace 4, has the advantage, among others, that it, in common with the pass-through furnace, can be aligned directly in a production line organized for work pieces which before their further processing require a heat treatment and, immediately thereafter, quenching. This objective is not readily possible, for example, in the case of oil quenching systems, because of the risk of fire connected therewith. In the case of the treatment of he present invention, the entire heat treatment procedure can be automated, so that if necessary the throughput of work pieces per unit of time can be raised, while at the same time the possibility is available for subjecting the work pieces, as may be selected, to a stepped chilling with different gas input temperatures in the individual stages, with even the possibility of inserting in-between operations for tempering the work piece, or the like. This can be explained briefly with reference to FIG. 6, as follows:

On the roller hearth furnace 4, in this case, the roller bearing rings 15 are transported parallel to each other through the furnace chamber 5 in rows of three, parallel to each other. As soon as the leading row of three roller bearing rings 15, continuously transported through the furnace, interrupts the light gate 65 disposed in the neighborhood of the furnace exit 22, an adjacent section 66 of the roller hearth in the exit side and leading to the quenching equipment is driven by a rapid action drive 67 which transports the roller bearing ring row through the furnace exit 22 into a first cooling station A with magnification of the spacing to the following roller bearing ring row. In the cooling station A three quenching devices 1 are adjacently parallel in a common casing 68 which is flange-attached directly to the exit side of the roller hearth furnace 4. The arrows 69 and 70 indicate the cooling gas input and exits in. FIG. 6. Each quenching apparatus 1 is constructed in a manner corresponding to FIG. 2.

After the three roller bearing rings of a row have been chilled simultaneously in the three quenching devices 1 of the first cooling station A to a predetermined first temperature value, they are carried over by manipulators (not shown) into the three following quenching devices 1 of a similarly constructed following second cooling station B, in which chilling to room temperature is produced, after which the work piece group consisting of three adjacent roller bearing rings 15 are carried away over the same support table 24.

Figure 7:
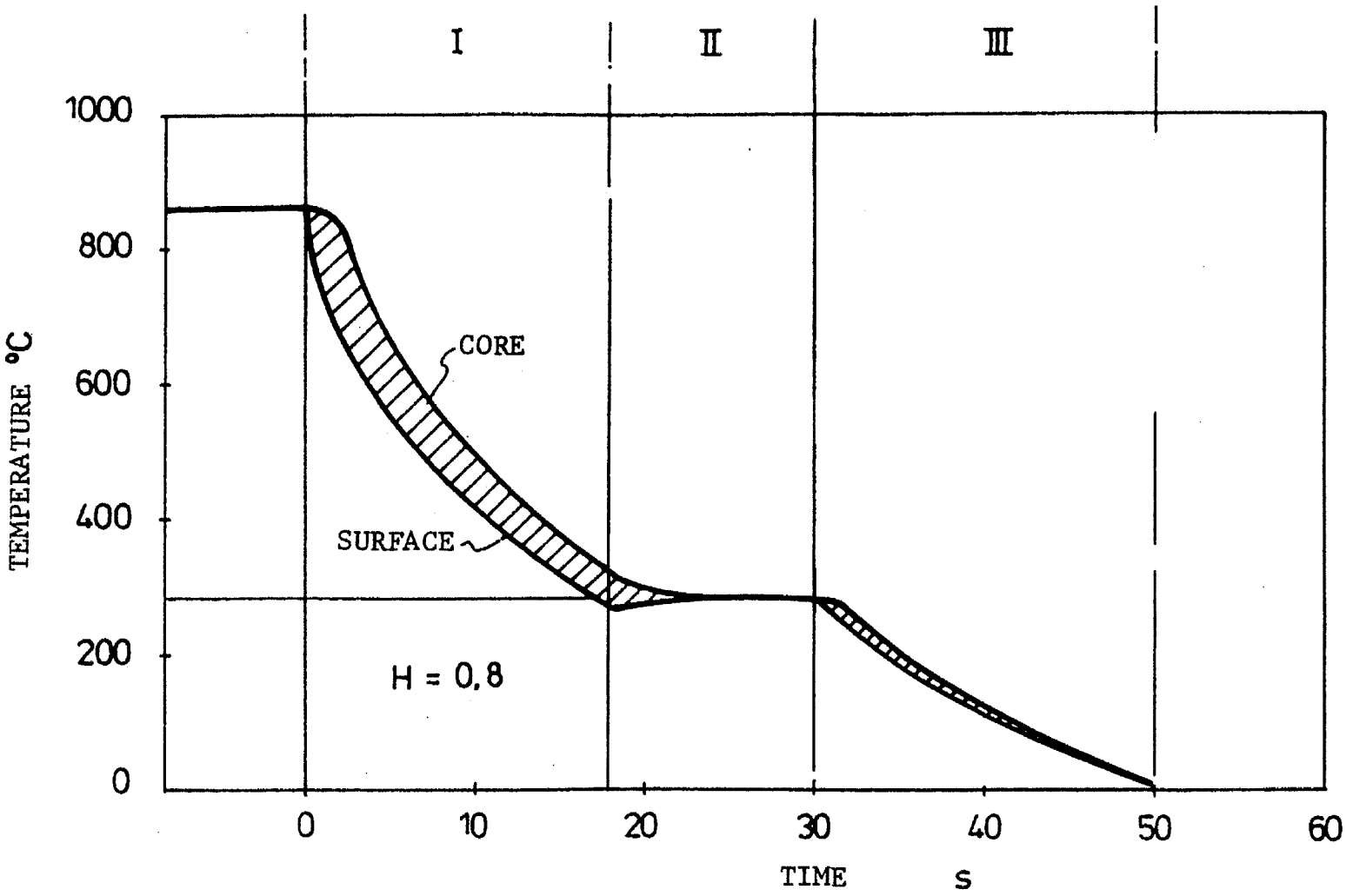
FIG. 7 is a diagram illustrating the course of temperature with time in the chilling of a ring in accordance with the invention in a gas nozzle field in which the nozzle diameter is 2 mm.

The temperature-time course in this step-wise quenching is illustrated in FIG. 7 and further explained with reference to the following example of the method of the invention:

EXAMPLE

A ring 15 of a roller bearing made of the material 100Cr6 is hardened in a nozzle field instead of the usual oil quenching.

| Workpiece data | |
|---|---|
| outer diameter: | 140 mm |
| inner diameter: | 116 mm |
| ring width: | 40 mm |
| weight: | 1.5 kg |
| surface (outer and inner): | 0.032 $m^2$ |
| weight/surface: | 47 $kg/m^2$ |

Since the critical cooling time from 800° to 500° C. for this steel is about 10 seconds, an H value of 0.8 is necessary, corresponding to a rapid oil chilling. The nozzle field 2 of FIG. 1 is selected for the ring size and width.

| Nozzle Field 2 | |
|---|---|
| Nozzle diameter: d: | 2 mm |
| Nozzle distr. t: | 10 mm |
| Spacing from cooled surface h: | 10 mm |
| Number of outer nozzles: | 200 |
| Number of inner nozzles: | 126 |
| Total number of nozzles: | 326 |
| Nozzle field surface: | 0.032 $m^2$ |
| total nozzle cross-section: | 0.001 $m^2$ |
| gas velocity: | 100 m/s |
| gas flow | 360 $m^3/h$ |
| Variant 1 | |
| for H = 0.8 in Phase I | |
| Cooling gas (50° C.) | 40% $N_2$, 20% CO, 40% $H_2$ (vol. %) Endothermic atmosphere generated from natural gas |
| Total pressure P | 2.5 bars (acc. to FIG. 1) |
| Blower power N | 80 $kW/m^2$ = 2.5 kW |
| Variant 2 | |
| for H = 0.8 in Phase I | |
| Cooling gas (50° C.) | 100% $N_2$ |
| Total pressure P | 6 bars (acc. to FIG. 1) |

-continued

| | |
|---|---|
| Blower power N | 320 kW/m$^2$ = 10 kW |

The blower power in the case of variant one is comparable to the power of the circulating pump of an oil bath. In the case of a cooling time of about 20 seconds per ring the energy requirement for each kilogram of hardened material is 0.01 kWh for variant one and 0.04 kWh for variant two. In the quenching phase the temperature in the core of the rotating rings is cooled down to 500° C. after 10 seconds. After 18 seconds 280° C. is reached at the surface of the ring (optical control) and the cooling is then turned off (cooling station A).

In phase II the ring can still be tempered at a defined temperature before the formation of martensite.

In phase III the ring is chilled at another nozzle station to about 0° C. for complete martensite formation with a chilled circulating gas (cooling station B).

The critical chilling time from 800 to 500° C., which in the case of the example was about 10 seconds, can be still shorter in the case on unalloyed or low-alloyed steels. The required rapid action of control of the quenching effect and the very short motion during the operation of the quenching equipment 1 can be readily obtained in a reproducible and economic manner in accordance with the invention, in contrast to the heretofore known gas cooling equipments. The necessary heat transfer between the work piece surface to be chilled and the gas stream can be obtained with high values of the heat transfer coefficient $\alpha$ in the method of the invention with nozzle fields of relatively small diameter d and at very small spacing h to the work piece surface to be cooled. Since the heat flow density at the work piece surface goes down in the first seconds into the region of MW/m$^2$ and there is at the same time a noticeable warming of the gas, the $\alpha$ values of the method cannot be correctly described, as has already been shown.

For this reason the quenching effect will be designated by the H value that is normal in the hardening of steel. The hardening at the work piece, i.e. the course of hardening across the cross-section of the work piece adjacent to the hardened surface, depends upon the material, i.e. the steel alloy, from the cross-section and from the quenching intensity (H value). From this known relation the H value of a hardened steel workpiece can be determined. For this purpose sample pieces have been used in practice which have mainly been of cylindrical shape.

Compare, for example "technologie der Warmepehandlung von Stahl", Veb deutscher Verlag fur Grundstoffindustrie Leipzig, second edition 2d ed., page 604). In the above-described example the nozzle field was equipped with 25 cylindrical nozzle pores. Basically other cross sectional shapes, such as slot nozzles or the like, would conceivably also be used and are mentioned here for completeness. All of the gases and gas mixtures useful for the particular application can be used as the cooling gas, among them air, nitrogen and the like.

In the new method the work pieces 15 are quenched throught individually, because as a rule it is possible only in this way to dispose the nozzle field to fit sufficiently narrowly to the shape of the work piece surfaces to be chilled at a sufficiently small spacing on the work piece.

In certain cases, for example in the case of ring-shaped work pieces, it is also conceiveable to put several work pieces somewhat one above another in a chamber surrounded by nozzle fields and to treat them therein, in which case, however, care must also be taken to assure that the fitting of the nozzle fields to the work piece surface shape remains good. A work piece can also consist of several small individual parts, for example of small screws etc. which lie in an aggregate of uniform small aggregate height on a carrier that permits the passage of gas therethrough, after the fashion of a wire basket. The nozzle field then directs its jets on the upper and/or lower side of the aggregate, the dimensions and shape of which is suitable or adapted to the shape of the nozzle field.

Depending on the shape and material of the work piece to be treated, the need can occasionally appear for providing in certain regions of the work piece surface to be chilled, to provide a different quenching intensity, in particular a smaller quenching intensity. This can be obtained, for example when nozzle bores 25 of the nozzle field—individually or by groups—are provided with closure valves or throttle devices. FIG. 3 shows and example for such a purpose in the form of a diaphragm ring 70 which is mounted for longitudinal shifting on the outer cylinder wall 13 of the insert 5.

With reference to FIG. 2 it was explained that the roller bearing ring 15 is rotated with respect to the fixed-location nozzle field during the chilling period. Alternatively the disposition could naturally also be constituted so that the roller bearing ring 15 is fixed, while the insert 5 and, therewith, the nozzle field execute a rotary movement. Axially up and down movements of the work piece and/or of the nozzle field are also conceivable and are obtainable with simple mechanical means.

A two-stage chilling of the roller bearing rings 15 in two cooling stations A and B located one behind the other is graphically described in FIG. 7. Such a subdivision into several cooling stations located one behind the other is often not necessary. By corresponding programming of the process computer 62 the result can also be obtained that after a predetermined time a throttling of the cooling effect can be brought about by a programmed reduction of the gas velocity w and/or the gas pressure p in order to immitate thereby the effect of an oil or warm salt bath hardening.

Although the invention has been described with reference to particular illustrative examples, it will be understood that variations and modifications are possible within the inventive concept.

I claim:

1. Apparatus for quenching annular, ring-shaped metallic workpieces (15) having inner and outer circumferential surfaces with a quenching intensity lying in an intensity range of 0.2 to 4 for oil or water quenching, by bringing a gaseous quenching medium into contact with to-be-cooled inner and outer surfaces of the workpiece, comprising:

a ring-shaped chamber structure having an outer cylindrical wall (12), an inner cylindrical wall (13) spaced from the outer wall, a bottom wall (11) connecting the inner and outer cylindrical walls, and defining a ring-shaped quenching chamber (14) therebetween, dimensioned to receive the workpiece (15) therein;

an array of gas transmission nozzles (25) forming a nozzle field and located in each of said inner and outer walls, projecting a gaseous quenching medium from the inner wall (13) on the inner surfaces of the workpiece (15) and from the outer wall on the outer surfaces of the workpiece (15);

workpiece support means (34, 43) for supporting an end surface of the ring-shaped workpiece (15) within said chamber in a fixed relationship with respect to said nozzle field;

said nozzle field being arranged spaced by a small distance from the inner and outer surfaces, respectively, of the workpiece (15) and located so as to at least approximately match the shape of said to-be-cooled surfaces of said workpiece (15) and to project on the inner and outer surfaces of the workpiece (15) discrete cooling gas jets from said nozzles (25) and thereby to produce a quenching intensity on said surfaces which is in the intensity range of 0.2 to 4 for oil or water quenching; and pressure means for controllably propelling said gaseous quenching medium through said nozzles (25) of said nozzle field and controllably projecting discrete jets of said quenching medium onto the workpiece (15) in said quenching chamber (14) and thereby controllably chilling and quenching said surfaces thereof, said pressure means including means for adjusting gas velocity through said nozzles and gas pressure upstream of said nozzles and also means for limiting propelling power of said pressure means to a value of power up to about 1,000 kW per square meter of nozzle field.

2. Apparatus according to claim 1, wherein said quenching chamber (14) is a chamber capable of operating as a pressure chamber at pressures above atmospheric pressure and is equipped with pressure resistant loading and unloading closure locks.

3. Apparatus according to claim 1, wherein at least a few nozzles (25) of said nozzle field are equipped with selectively actuatable valve means (70) for reducing flow therethrough.

4. Apparatus according to claim 1, wherein at least a portion of said nozzle field is an interchangeable unit inserted in a casing (2).

5. Apparatus according to claim 1, wherein said workpieces are bearing rings, and wherein said quenching chamber (14) includes driving means coupled to said support means for providing relative rotary movement of said workpiece and at least a part of said nozzle field about an axis of symmetry (33) of said workpiece.

6. Apparatus according to claim 5, wherein said means for producing relative driving movement includes a turbine unit (42) disposed for being rotated by said cooling gas for energizing said driving means.

7. Apparatus according to claim 1, wherein measuring devices (63, 64) are provided in said chamber (14) to provide indication of workpiece temperature during quenching.

8. Apparatus according to claim 2, wherein measuring devices (63, 64) are provided in said chamber (14) for indication of workpiece temperature during quenching.

9. Apparatus according to claim 3, wherein measuring devices (63, 64) are provided in said chamber (14) for indication of workpiece temperature during quenching.

10. Apparatus according to claim 5, wherein measuring devices (63, 64) are provided in said chamber (14) for indication of workpiece temperature during quenching.

11. Apparatus according to claim 1, including means for adjusting gas velocity and gas pressure of said gaseous quenching medium and for controllably projecting discrete jets of said quenching medium, through said nozzles including a process computer (62), for controlling the time course of quenching said workpiece, to which there are supplied as input signals process data including at least one of flow quantity, pressure, temperature and composition of cooling gas, and workpiece-specific data, including at least one of geometric shape and dimensions and material composition and optionally characteristic data of said nozzle field, and from which output signals calculated in accordance with a program of said process computer are provided as output signals for affecting the cooling gas jet output of said nozzle field, the cooling gas throughput cross-section of at least a few nozzles (25) of said nozzle field or a relative movement between said workpiece (15) and said nozzle field either individually or by two or more of said output signals simultaneously.

12. Apparatus according to claim 1, wherein said means for controllably ejecting discrete gas jets and controllably quenching said surfaces of said workpiece as well as for adjusting gas velocity through said nozzles and gas pressures upstream of said nozzles include programmed control means (62) for affecting the quenching effect of said gas jets on said to-be-cooled workpiece surfaces, are controllable for imitating the quenching effect of an oil or warm-salt-bed hardening by controlling at least one of: quenching gas velocity, pressure behind gas jets and diameter or cross-section of said nozzles.

13. Apparatus according to claim 11, wherein said apparatus is located directly at an output of a furnace chamber (**4*a***) of a continuous pass-through furnace containing a protective gas atmosphere.

14. Apparatus according to claim 13, wherein said apparatus contains a loading and unloading chamber (21) connected to said furnace chamber (**4*a*) and closeable to the exterior of said furnace and said apparatus by a selectively actuatable door (23**).

15. Apparatus according to claim 2, wherein said pressure resistant loading and unloading closure locks close a loading and unloading quenching chamber (21) which is connected to said chamber (14) through selectively actuatable closure means (16).

16. Apparatus according to claim 1, wherein a plurality of said quenching chambers (14), the entire chamber space of which is at least partly surrounded by an array of nozzles in a nozzle field are provided and located next to one another and optionally operated in parallel for simultaneous quenching of workpieces, respectively, in respective quenching chambers (14).

17. Apparatus according to claim 1, comprising a plurality of quenching chambers (14) of which the interior space is at least partly surrounded by an array of nozzles (25) in a nozzle field for exposing said workpiece to the gaseous quenching medium, disposed one behind the other with respect to conveyor means for said workpiece, said respective chambers and their respective nozzle fields being adapted for providing different quenching conditions.

18. Apparatus according to claim 17, wherein there is interposed between two of said plurality of chambers (14) a treatment station for said workpiece which is not a quenching treatment station.

19. Apparatus according to claim 12, wherein measuring devices (63, 64) are provided in said quenching chamber (14) for indication of workpiece temperature during quenching.

20. Apparatus according to claim 1 wherein the chamber structure comprises first and second essentially concentric, hollow cylindrical elements (12, 13) forming said inner and outer cylindrical walls, the first element (13) being located within the second element (12) , and defining said quenching chamber (14) therebetween;

wherein the nozzles (25) project through said elements toward said chamber (14); and wherein the hollow interior of the first element (13) forms a supply duct for the quenching medium to the nozzles (25) with the first element.

21. Apparatus according to claim 1, in combination with said workpiece (15), wherein said workpiece comprises a bearing ring.

22. Apparatus according to claim 1, in combination with said workpiece (15), wherein said workpiece comprises a roller bearing ring.

* * * * *